US008172348B2

(12) United States Patent
Martin et al.

(10) Patent No.: US 8,172,348 B2
(45) Date of Patent: May 8, 2012

(54) PRINT HEAD CAP VENT

(75) Inventors: Warren Scott Martin, Vancouver, WA (US); Ian Patrick Anderson, Portland, OR (US); Lynn A. Collie, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 807 days.

(21) Appl. No.: 12/258,597

(22) Filed: Oct. 27, 2008

(65) Prior Publication Data

US 2009/0237424 A1 Sep. 24, 2009

Related U.S. Application Data

(60) Provisional application No. 61/039,105, filed on Mar. 24, 2008.

(51) Int. Cl.
*B41J 2/175* (2006.01)

(52) U.S. Cl. ..... 347/6

(58) Field of Classification Search ..... None
See application file for complete search history.

(56) References Cited

U.S. PATENT DOCUMENTS 4,577,203 A * 3/1986 Kawamura ..... 347/30
4,847,637 A 7/1989 Watanabe et al.
5,086,305 A 2/1992 Terasawa
5,185,614 A 2/1993 Courian et al.
5,289,207 A 2/1994 Ebisawa
5,412,411 A 5/1995 Anderson
5,706,038 A 1/1998 Jackson et al.
5,963,228 A 10/1999 Purwins
6,036,299 A 3/2000 Kobayashi et al.
6,196,655 B1 3/2001 Hiraswawa et al.
6,293,648 B1 9/2001 Anderson
6,305,778 B1 10/2001 Kobayashi et al.
6,390,592 B2 5/2002 Okamura
6,406,123 B1 6/2002 Usui et al.
6,422,680 B1 * 7/2002 Hayakawa et al. ..... 347/30
6,682,166 B2 1/2004 Shimizu
6,702,423 B2 3/2004 Okamura
6,808,246 B2 10/2004 Long
6,916,080 B2 * 7/2005 Okamoto ..... 347/29
6,994,416 B2 2/2006 Seki et al.
7,144,096 B2 12/2006 Seki et al.
2002/0001012 A1 1/2002 Okamura
2002/0060713 A1 5/2002 Katakura
2002/0122091 A1 9/2002 Jackson
2002/0196306 A1 12/2002 Shimizu
2004/0113970 A1 6/2004 Long

* cited by examiner

*Primary Examiner* — Stephen Meier
*Assistant Examiner* — Alexander C Witkowski

(57) ABSTRACT

A print head cap includes a vent which is opened during storage of the print head against the cap, is closed during priming of fluid through nozzles of the print head and is opened to stop the priming. Pumping of fluid from the cap is started substantially immediately upon opening of the vent to stop priming.

24 Claims, 8 Drawing Sheets

PRINT HEAD CAP VENT

CROSS REFERENCE TO RELATED APPLICATIONS

This application claims the benefit of provisional patent application Ser. No. 61/039,105, filed Mar. 24, 2008 titled "PRINT HEAD CAP VENT" which application is incorporated by reference herein as if reproduced in full below.

BACKGROUND

Fluid delivery systems supply fluid through print head nozzles. The nozzles are sometimes primed by a cap that draws fluid through the nozzles. The print head is sealed against the cap during periods of non-use to keep the nozzles from drying out. During such periods, fluid may drool from the nozzles, leading to cross contamination of fluids and subsequent printing quality issues.

DETAILED DESCRIPTION OF THE EXAMPLE EMBODIMENTS

Figure 1:
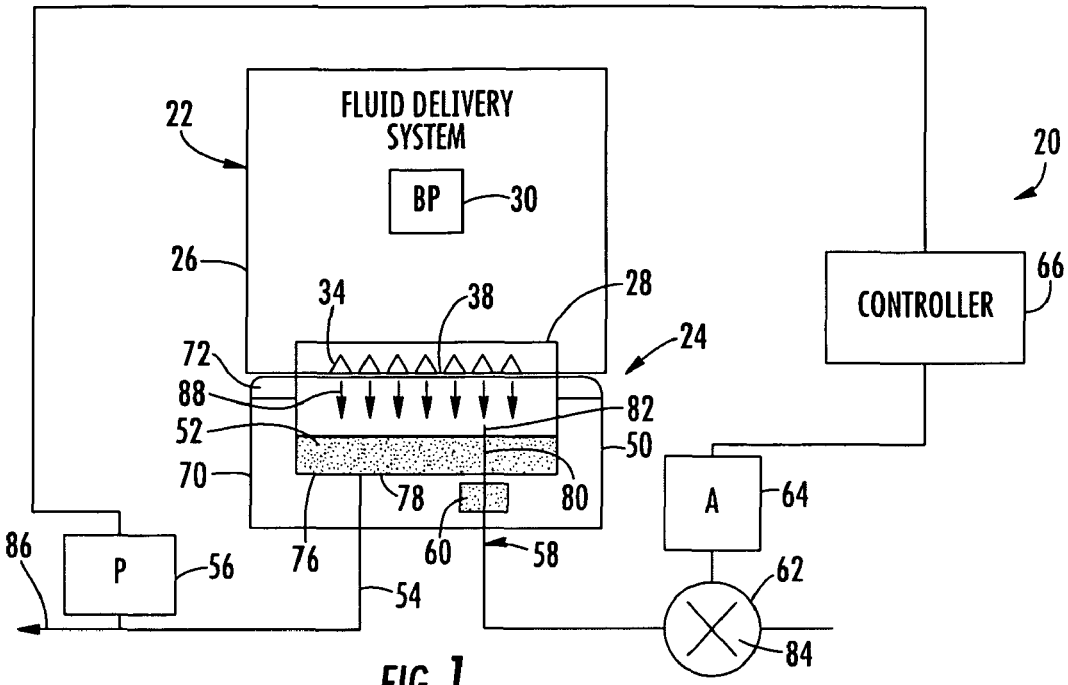
FIG. 1 is a schematic illustration of a fluid delivery and service system during priming according to an example embodiment.

FIG. 1 schematically illustrates fluid delivery and servicing system 20 according to an example embodiment. System 20 is configured to dispense fluid, such as ink or other fluids, in a controlled manner using drop-on-demand inkjet print heads. System 20 is further configured to service the print heads by drawing or purging fluid through nozzles of the one or more print heads to prime the nozzles and to further cap or substantially seal the nozzles during periods of non use. As will be described hereafter, system 20 performs such servicing of the one or more print heads with a reduced likelihood of drool through the nozzles and a reduced likelihood of fluid cross contamination.

Fluid delivery and servicing system 20 includes fluid delivery system 22 and servicing system 24. Fluid delivery system 22 comprises a device configured to selectively eject fluid through one or more nozzles or nozzle openings. Fluid delivery system 22 includes fluid supply 26, print head 28 and back pressure regulator 30.

Fluid supply 26 supplies fluid, such as ink or other fluids, to print head 28. In one embodiment, fluid supply 26 comprises a self-contained container at least partially filled with the fluid to be delivered to print head 28. In another embodiment, fluid supply 26 may comprise a temporary fluid storage container configured to receive fluid from a remote main fluid source such as with an off-axis fluid supply. In one embodiment, fluid may circulate across fluid supply 26. Fluid supply 26 may have a variety of different sizes, shapes and configurations.

Print head 28 comprises one or more print heads configured to eject one or more fluids through nozzles 34 (schematically represented). In one embodiment, print head 28 comprises one or more drop-on-demand inkjet print heads. In one embodiment, print head 28 comprises a thermoelectric ink jet print head. In other embodiments, print head 28 may comprise other forms of drop-on-demand inkjet print heads, such as piezo electric print heads.

In one embodiment, fluid supply 26 supplies distinct fluids to distinct groups of nozzles 34 of the one or more print heads 28. For example, in one embodiment, fluid supply 26 delivers different colors of fluid ink to different groups of nozzles of the one or more print heads 28. In particular, in one embodiment, fluid supply 26 includes three distinct chambers containing cyan, magenta and yellow colors of ink, wherein the different colors of ink are delivered to distinct groups of nozzles 34 of the one or more print heads 28. In still other embodiments, fluid delivery system 22 may include a greater or fewer of such compartments for delivering a greater or fewer of distinct colors of ink or distinct fluid compositions to distinct groups of nozzles 34.

As further schematically shown by FIG. 1, print head 28 has exterior surfaces 38 extending about and between adjacent nozzles 34 that generally face the surface being printed upon. In one embodiment, such surfaces 38 have a high surface energy relative to the fluid being ejected through nozzles 34. In other words, such surfaces 38 are hydrophilic or fluid-philic with respect to the fluid being ejected through nozzles 34 such that the fluid being ejected through nozzles 34 is less likely to bead up along surfaces 38 and is more likely to spread across surfaces 38, increasing the risk of one fluid traveling or flowing across surface 38 between adjacent nozzles and mixing with another distinct fluid, causing cross-contamination or mixing of distinct fluids or distinct colors of ink along surfaces 38. As will be described hereafter, the mixed inks may further be drawn back through nozzles 34 creating cross-contamination within print head 28.

Although increasing the likelihood of cross-contamination along surfaces 38, such higher surface energies of surfaces 38 may permit a larger range or variety of fluids to be ejected through nozzles 34 with greater control, precision or accuracy. The higher surface energies of surface 38 may permit the ejection of particular fluids or particular inks providing enhanced image quality or providing other desired physical or chemical characteristics of the printed fluid. In one embodiment, surfaces 38 have a surface energy of at least 45 dynes/cm and nominally about 70 dynes/cm. In one embodiment, surface 38 is formed from SU8. In other embodiments, surface 38 may have other surface energies or may be formed from other materials or coated with a secondary layer of significantly reduced surface energy.

Back pressure regulator 30 comprises one or more structures configured to create a fluid back pressure within the interior of fluid supply 26. Back pressure regulator 30 assists in reducing a likelihood of fluid drooling through nozzles 30 onto surfaces 38 during periods of non-use or when printing is not taking place. According one embodiment, back pressure regulator 30 provides a relatively low degree of back pressure, reducing the amount of force or the amount of energy used to expel or eject fluid through nozzles 34 against the back pressure of back pressure regulator 30. In some fluid delivery systems 22, a relatively low level of back pressure (as provided by back pressure 30) enables high flow rates necessary for increased throughput printing. According to one embodiment, back pressure regulator 30 has a back pressure of less than or equal to 0.5 inches and nominally 1.5 inches $H_2O$. In one embodiment, back pressure regulator 30 may be provided by the capillary action of one or more porous materials such as foams and the like. In other embodiments, back pressure regulator 30 may be provided by a back pressure regulating bag. In still other embodiments, back pressure regulator 30 may be provided by other back pressure controlling devices and may provide other levels of back pressure.

Servicing system 24 is configured to service print head 28 of fluid delivery system 22. In particular, servicing system 24 is configured to draw or purge fluid through nozzles 38 to prime nozzles 38, and to remove trapped air from the fluid delivery system 22 that can block fluid flow during printing. Servicing system 24 is further configured to at least partially seal against print head 28 and about nozzles 34 during storage or non-use of print head 28. Servicing system 24 includes cap 50, absorber 52, purging conduit 54, pump 56, vent conduit 58, absorber 60, valve 62, actuator 64 and controller 66.

Cap 50 comprises a structure configured to contact and seal against fluid delivery system 22 so as to form a substantial seal about print head 28, facilitating the purging of nozzles 34 as well as the capping and storage of nozzles 34. Cap 50 includes body 70 and seal 72. Body 76 is configured so as to extend about nozzles 34 of print head 28 when system 22 is positioned against and opposite to body 50. Body 50 further forms a basin 76 configured to extend opposite to nozzles 34. Basin 76 comprises a cavity or recess configured to receive fluid or ink ejected through nozzles 34 during priming. Basin 76 further provides a substantially sealed volume adjacent to nozzles 34 during capping and storage.

Seal 72 comprises a structure configured to bear against and contact portions of system 22 in close conformity so as to seal about nozzles 34. In one embodiment, seal 72 comprises a substantially uninterrupted ring of resiliently flexible elastomer material configured to surround nozzles 34. In other embodiments, seal 72 may be formed from other materials. In other embodiments, in lieu of seal 72 being provided as part of cap 50, seal 72 may alternatively be provided as part of system 22 about nozzles 34. Absorber 52 comprises one or more members received within basin 76 and configured to absorb fluid received from nozzles 34. In one embodiment, absorber 52 comprises a pad of absorbent material such as sintered plastic. In other embodiments, absorber 52 may comprise one or more pads or one or more layers of other materials configured to absorb the fluid or ink purged through nozzles 34. In still other embodiments, absorber 52 may be omitted.

Purge conduit 54 comprises a passage, conduit, tube or other fluid directing or channeling structure in fluid communication with basin 76 such that fluid within basin 76 and retained by absorber 52 may be drawn through conduit 54 out of basin 76. For purposes of this disclosure, the term "fluid" encompasses both liquids and gases. In the example illustrated, conduit 54 enables air to be withdrawn from basin 76 so as to create a vacuum within basin 76. Conduit 54 further permits liquids drawn through nozzles 34 into basin 76 to be withdrawn from basin 76. In the example illustrated, conduit 54 has an opening or mouth adjacent to a floor 78 of the basin 76 and extends through body 50. In other embodiments, conduit 54 may have other configurations.

Pump 56 comprising device configured to draw fluid through conduit 54. In one embodiment, pump 56 comprises a peristaltic pump configured to periodically squeeze or occlude a flexible wall of conduit 54 to move fluid through conduit 54. In other embodiments, pump 56 may comprise other devices configured to pump or move fluid through conduit 54 in response to control signals from controller 66.

Vent conduit 58 comprises one or more structures forming and providing a fluid passage extending from the interior of basin 76 to atmosphere or another source of air. In the example illustrating, vent conduit 58 provides pneumatic flow or communication between the interior basin 76 and an exterior of cap 50. In one embodiment, vent conduit 58 has an inside diameter sufficiently small and a length sufficiently long so as to reduce or minimize water loss through vent conduit 58 during storage of print head 28. As will be described in more detail hereafter, vent conduit 58 supplies air to basin 76 during capping and storage of fluid delivery system 22 to maintain a pressure within basin 76 such that the back pressure provided by back pressure regulator 30 is sufficiently large to reduce or inhibit drooling of fluid through nozzles 34.

In the example illustrated, vent conduit 58 includes a snorkel 80. Snorkel 80 comprises that portion of vent conduit 58 that extends beyond floor 78 of the basin 76 into the interior of basin 76. Snorkel 80 projects beyond floor 78 by distance sufficient such that the inlet opening 82 of snorkel 80 is elevated beyond or above the top of the absorber 52. The snorkel 80 is elevated beyond or above the top of the absorber 52 such that residual ink after a purge or unexpected drool while capped will be contained within the absorber 52 and not leak into the vent conduit 58 via the snorkel opening 82 within basin 76. The snorkel 82 assists in reducing the amount of liquid that may flow into vent conduit 58 and potentially form a blockage leading to a flow restriction in vent conduit 58. In other words, snorkel 82 assists in keeping vent conduit 58 dry and open. In other embodiments, snorkel 80 may be omitted.

Absorber 60 comprises one or more members configured to absorb liquid. Absorber 60 is supported or located in communication with the fluid passage provided by vent conduit 58 so as to absorb any liquid that may collect within the fluid passage of vent conduit 58. In the embodiment illustrated, absorber 60 completely surrounds or extends about the fluid passage of vent conduit 58. For example, in one embodiment, absorber 60 comprises a ring of absorbent material. Because absorber 60 extends completely around or about the fluid passage, absorber 60 has enhanced effectiveness in absorbing any liquids that may collect within vent 50 and in keeping vent 50 dry and open to atmosphere. In other embodiments, absorber 60 includes multiple portions staggered about the fluid passage of and 58 or may extend along sides of the fluid passage.

In the example illustrated, absorber 60 is located proximate to floor 78 of basin 76. As a result, absorber 60 is more likely to absorb liquid that may enter vent conduit 58. In other embodiments, absorber 60 may be provided in other locations along conduit 58. In one embodiment, absorber 60 may be formed from a liquid absorbent material such as sintered plastic. In other embodiments, absorber 60 may be formed from other of liquid absorbent materials. In still other embodiments, absorber 60 may be omitted.

Valve 62 comprises a mechanism situated along vent conduit 58 and configured to selectively open and close vent conduit 58. Actuator 64 comprises a mechanism configured to actuate or move valve 62 between a vent closing state and a vent opening state. Actuator 64 actuates valve 62 in response to control signals received from controller 66. In one embodiment, actuator 64 comprises an electric solenoid. In other embodiments, actuator 64 may comprise other mechanisms such as motor driven cam arrangements, hydraulic or pneumatic cylinder-piston assemblies and the like.

Controller 66 comprises one or more processing units configured to generate control signals directing at least the operation of pump 56 and actuator 64. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 66 may be embodied as part of one or more application-specific integrated circuits (ASICs). Unless otherwise specifically noted, the controller is not limited to any specific combination of hardware circuitry and software, nor to any particular source for the instructions executed by the processing unit.

Figure 3:
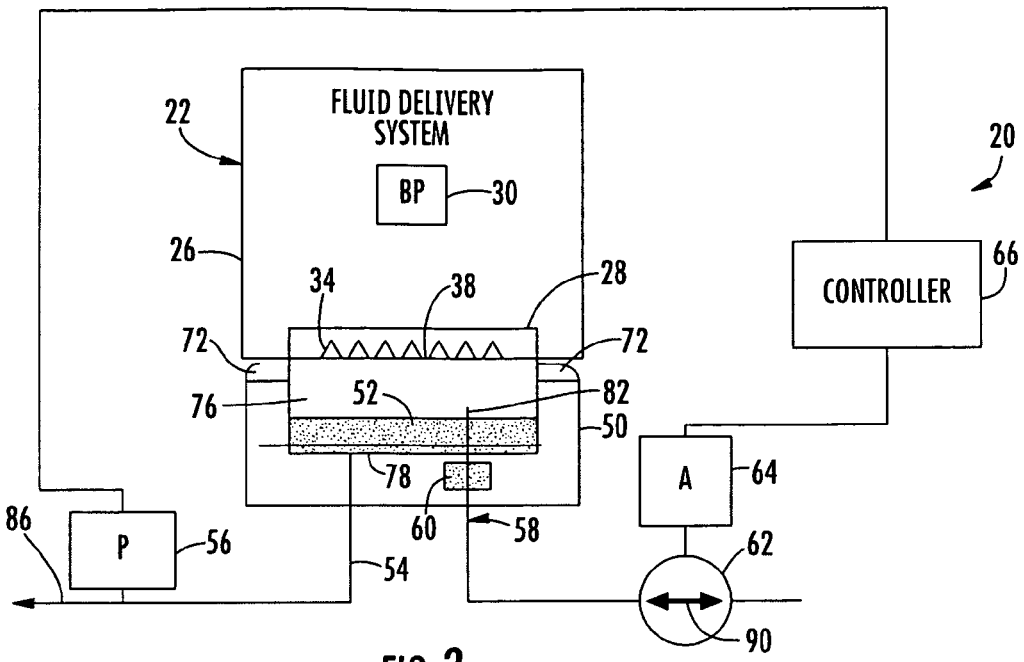
FIG. 3 is a schematic illustration of the system of FIG. 1 during purging after completion of priming according to an example embodiment.
Figure 4:
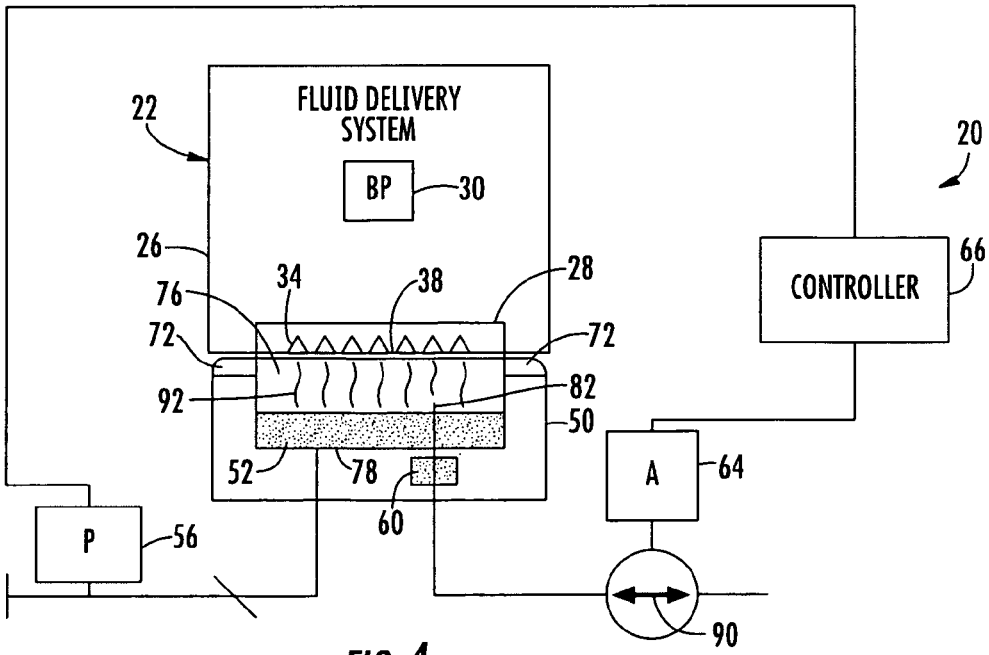
FIG. 4 is a schematic illustration of the system of FIG. 1 during capping and storage according to an example embodiment.
Figure 5:
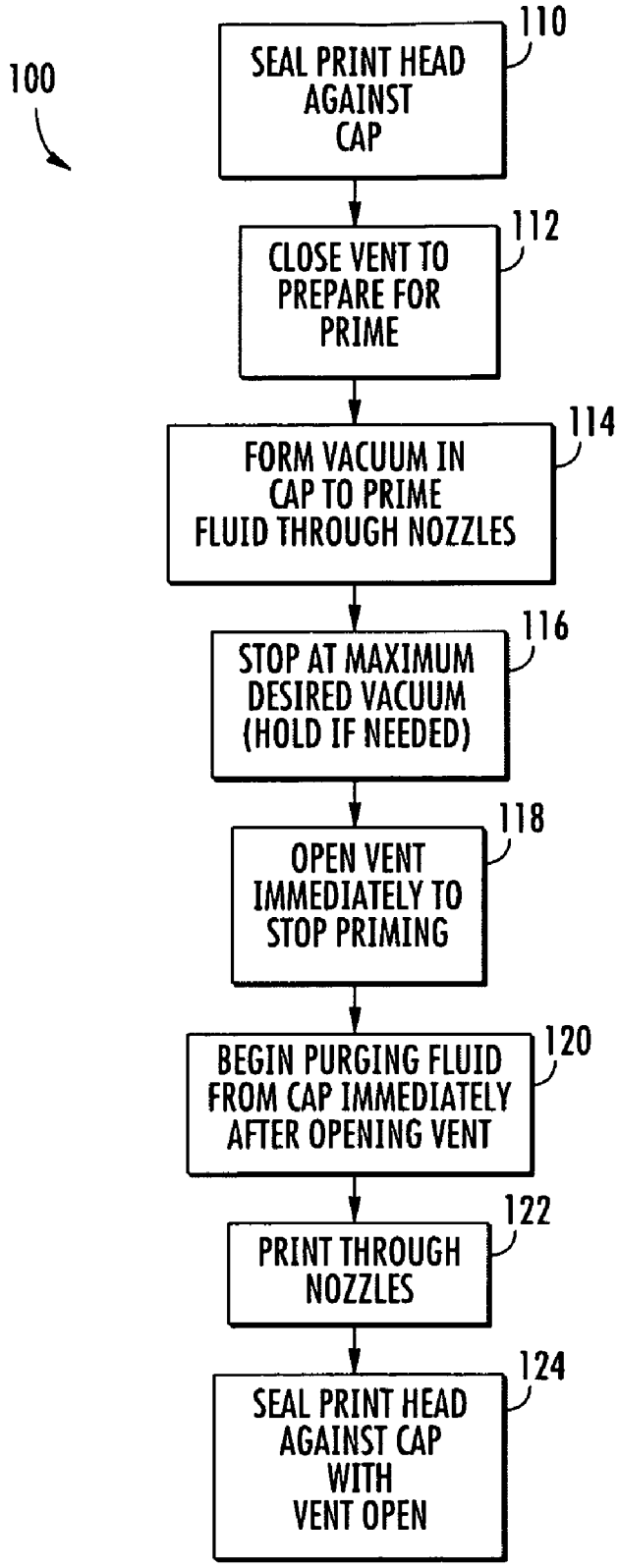
FIG. 5 is a flow diagram of a method for using the system of FIG. 1 according to an example embodiment.

FIGS. 1-5 illustrate operation of fluid delivery and servicing system 20 based in part upon control signals generated by controller 66. FIG. 5 is a flow diagram illustrating a method 100 using system 20. FIGS. 1-4 schematically illustrate system 20 operating according to method 100.

As represented by step 110 in FIG. 5, print head 28 is initially sealed against cap 50 as shown in FIG. 1. If print head 28 has been in storage and has been capped by cap 58, print head 28 may already be positioned opposite to cap 50. Alternatively, if print head 28 has been printing and is to be primed before another printing cycle is performed, print head 28 and/or cap 50 may be moved so as to position cap 50 and print head 28 opposite to one another and in sealing engagement with one another. In one embodiment, print head 28 may be moved by a carriage to a position opposite to cap 50. In another embodiment, 50 may be part of a service station that is moved to a position opposite to print head 28.

Controller 66 determines when print head 28 has been properly sealed against cap 50. In one embodiment, controller 66 may itself generate the control signals that cause the movement of print head 28 and/or cap 50 to positions opposite to one another to provide such sealing engagement. In another embodiment, controller 66 may receive signals from one or more sensors (not shown) which detect such positioning of print head 28 and cap 50.

As represented by steps 112 and 114 in FIG. 5, once print head 28 has been sealed against cap 50 and generally opposite to basin 76, controller 66 generates control signals causing a vacuum to be formed in basin 76 of cap 50 to draw or prime fluid through nozzles 34 as shown in FIG. 1. In particular, controller 66 generates control signals directing actuator 64 to actuate valve 62 to a vent closing state (schematically represented by the X 84). The actuation of valve 62 to the vent closing state may occur before or after the time at which print head 28 has been sealed against cap 50. Controller 66 further generates control signals directing pump 56 to pump fluid out of basin 76 as schematically represented by arrow 86 in FIG. 1. Initially, pump 56 pumps largely air or gas from basin 76. Because vent conduit 58 is closed by a valve 62 and because the interior basin 76 is a sealed volume, being sealed against supply 26, the removal of gas from basin 76 forms a vacuum in basin 76. This vacuum increases to an extent so as to exceed the back pressure provided by back pressure regulator 30. As a result, fluid comprising largely liquid, is drawn or pulled from within supply 26 through nozzles 34 and into base in 76 as schematically represented by arrows 88. This movement of liquid through nozzles 34 primes nozzles 34 and also ensures that fluid flow is not impeded by air block in the fluid delivery system 22 during subsequent printing.

During such priming of nozzles 34, the liquid primed through nozzles 34 floods the cap 50 prior to being drawn through the purge conduit 54 by pump 56. As noted above, snorkel 80 projects beyond the level of absorber 52 within basin 76 to assist in keeping vent conduit 58 dry in general. However, during priming, the snorkel inlet 82 may be covered completely by liquid. In order to keep liquid from being drawn into the snorkel inlet 82 and down the snorkel 80 during priming, the pressure in the purge conduit 54 is controlled or set so as to be less than pressure in the cap which is less than pressure in the vent conduit 58. Vent conduit 58 is in a closed state during priming. As a result, air pressure within vent conduit 58 further inhibits entry of primed liquids into vent conduit 58. By keeping vent conduit 58 dry, there is a reduced likelihood that liquids within vent conduit 58 will form a blockage that creates a flow restriction in vent conduit 58 and prevents its subsequent use. As shown by step 116, pumping of fluid (and the resulting vacuum in basin 76) is continued until a maximum desired vacuum is attained. In some embodiments, pumping may be continued, but adjusted, to maintain a desired vacuum level.

Figure 2:
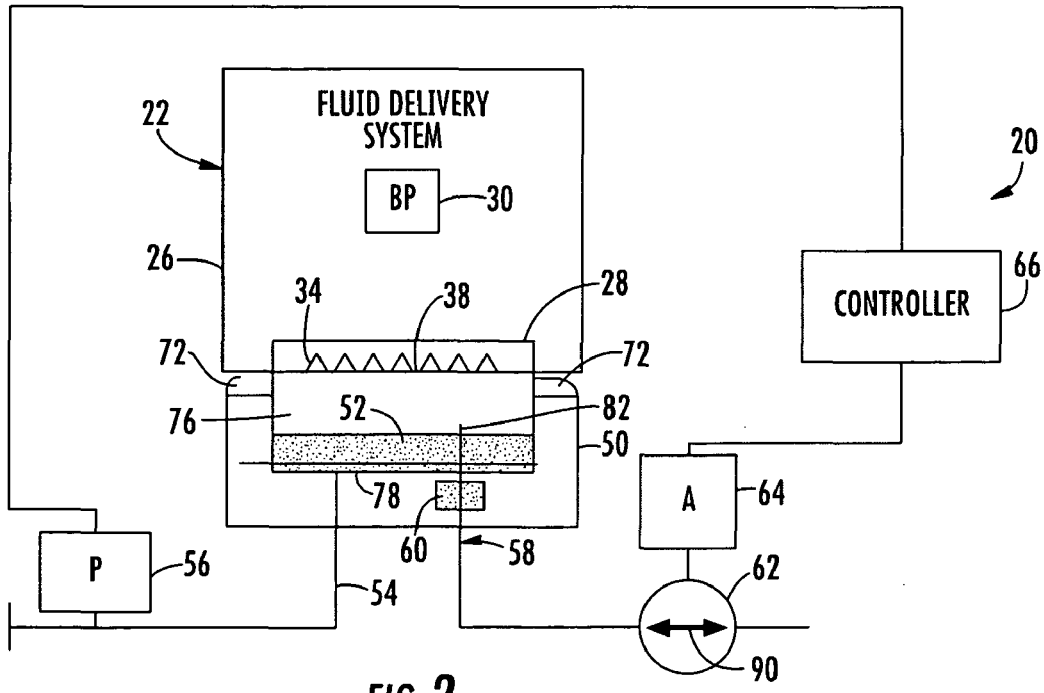
FIG. 2 is a schematic illustration of the system of FIG. 1 substantially immediately after completion of such priming according to an example embodiment.

As shown by steps 116 and 118, the priming of liquid through nozzles 34 continues until stopped by controller 66. Controller 66 may cease the priming of liquids in response to the lapse of a predetermined period of time or in response to other sensed characteristics or conditions. As shown by FIG. 2 and represented by step 116 in FIG. 5, when such priming is to be completed, controller 66 generates control signals directing pump 56 to stop pumping fluid from basin 76 through purge conduit 54.

As represented by step 118 in FIG. 5 and schematically shown in FIG. 2, substantially immediately upon pump 56 no longer pumping, controller 66 also generates control signals directing actuator 64 to actuate valve 62 to the vent opening state or position (schematically represented by arrows 90).

As represented by step 120 in FIG. 5 and shown by FIG. 3, substantially immediately upon completion of actuation of valve 62 to open the vent to stop priming, controller 66 generates control signals directing the pump 56 to begin pumping once again to remove excess liquid, such as ink, from the basin 76 and the purge conduit 54. In practical applications it is not possible to remove all the liquid present in the purge conduit 54 and the basin 76, which is one of the reasons for inclusion of the absorber 52. As a result of rapid switching from pumping to valve actuation and back to pumping again, little or no liquid within basin 76 is drawn into vent conduit 58. Absent such substantially immediate pumping or purging of liquid following the opening of vent conduit 58 to stop priming, liquid within conduit 54 may flow back into basin 76 and into vent conduit 58 due to vent conduit 58 being at a lower pressure than the pressure within basin 76. By substantially immediately pumping liquid following the opening of vent conduit 58, the drawing of liquid into vent conduit 58 may be avoided.

In one embodiment, at cap pressures greater than 100 inches H20, valve 62 is actuated to the vent opening state no greater than 60 ms after the cessation of pumping by pump 56. In other embodiments, the delay between the cessation of pumping by pump 56 and the opening of vent conduit 58 may be increased depending upon the particular characteristics of system 20 so long as the delay is sufficiently short to substantially prevent or inhibit the drawing of liquid into vent conduit 58 before vent conduit 58 is opened.

As represented by step 122, fluid delivery system 22 is withdrawn from cap 50 and is positioned opposite to media to be printed upon. Fluid, such as ink, is ejected through nozzles 34 in a controlled fashion. In one embodiment, distinct fluids, such as differently colored inks, or ejected through distinct groups of nozzles 34 of print head 28 during printing. The relatively low back pressure provided by back pressure regulator 30 and the high surface energy of surfaces 38 permit a wider range of fluids having improved performance characteristics to be used.

As represented by step 124 and shown by FIG. 4, after such printing, fluid delivery system 22 is once again positioned with respect to cap 50 and servicing station 24 to seal print head 28 against cap 50 with vent conduit 58 in the open state as schematically represented by arrows 90. In one embodiment, once the print head 28 is sealed against cap 50, both the purge conduit 54 and vent conduit 58 are open to atmosphere. Because the purge conduit 54 and absorber 52 always contain residual trapped liquid, a dry path to atmosphere is not possible through the pump 56. As schematically represented by wavy lines 92, heat is emitted by print head 28 when print head 28 is initially positioned in sealing engagement with cap 50. This heat is generated during printing with print head 28. As a result, the air within basin 76 is warmed. However, as the warmed air cools, it contracts, which can create a vacuum in the basin 76 and on the nozzles 34. If this vacuum is allowed to persist, this vacuum may be sufficiently large so as to overcome the back pressure provided by back pressure regulator 30, causing liquids, such as ink, to be pulled or drawn through nozzles 34 onto surfaces 38.

This drooling of liquid in combination with the high surface energy of surfaces 38 may allow such liquids to spread and potentially cross contaminate with one another. However, because vent conduit 58 provides an open atmospheric fluid passage plumbed to the interior of basin 76, air may be quickly drawn into basin 76 to accommodate the contraction of the previously warmed air, reducing or eliminating this vacuum. Consequently, the drooling of fluid is reduced or prevented, enhancing subsequent print quality or performance.

Figure 6:
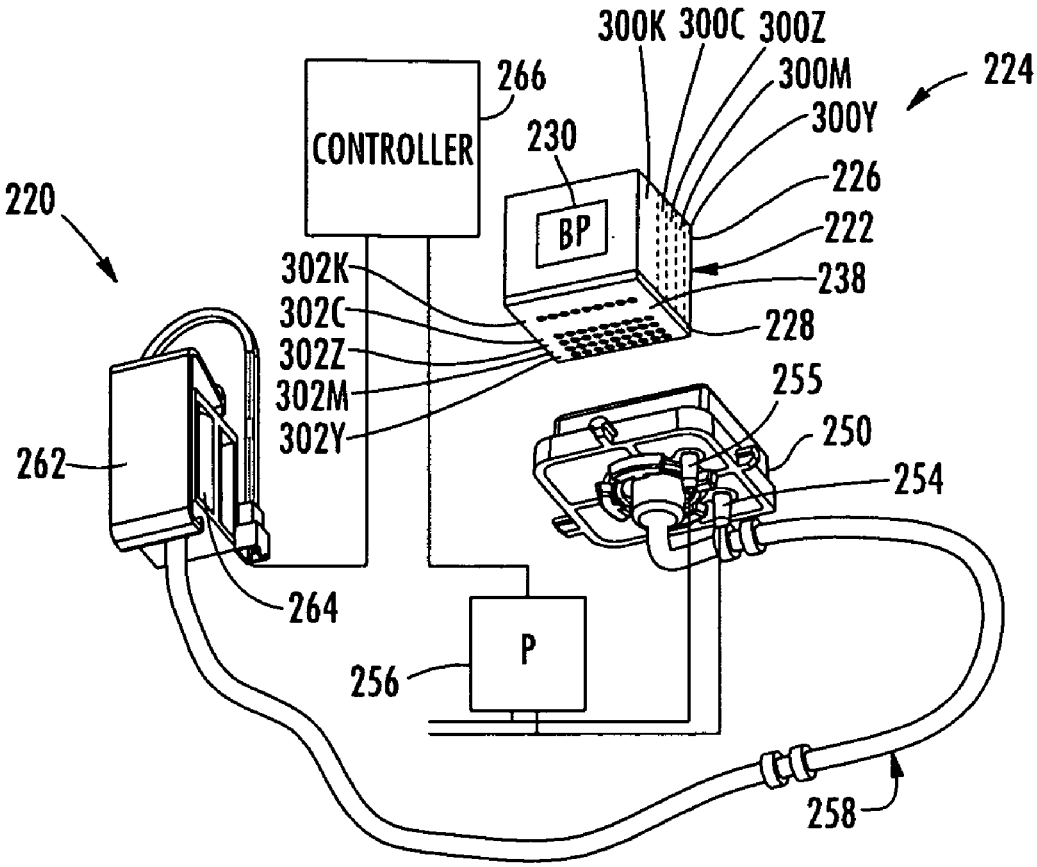
FIG. 6 is a perspective view of another embodiment of the system of FIG. 1 according to an example embodiment.

FIG. 6 illustrates fluid delivery and servicing system 220, a particular embodiment of fluid delivery and servicing system 20. Like system 20, system 220 is configured to service the print heads by drawing or purging fluid through nozzles of the one or more print heads to prime the nozzles and to further cap or substantially seal the nozzles during periods of non use. Like system 20, system 220 performs such servicing of the one or more print heads with a reduced likelihood of drool through the nozzles and a reduced likelihood of fluid cross contamination.

Fluid delivery and servicing system 20 includes fluid delivery system 222 and servicing system 224. Fluid delivery system 222 comprises a device configured to selectively eject fluid through one or more nozzles or nozzle openings. Fluid delivery system 222 includes fluid supply 226, print head 228 and back pressure regulator 230.

Fluid supply 226 supplies fluid such as ink or other fluids to print head 228. In the example illustrated, fluid supply 226 is configured to supply four distinct fluids. In one embodiment, fluid supply 226 comprises a self-contained container at least partially filled with the fluid to be delivered to print head 228. In another embodiment, fluid supply 226 may comprise a temporary fluid storage container configured to receive fluids from a remote main fluid source such as with an off-axis fluid supply. In one embodiment, fluid may circulate across fluid supply 226. Fluid supply 226 may have a variety of different sizes, shapes and configurations.

In the example illustrated, fluid supply 226 includes internal chambers 300K, 300C, 300M, 300Y, 300Z configured to supply black, cyan, magenta, yellow, and gray colored inks, respectively. In other embodiments, fluid supply 226 may include a greater or fewer of such chambers. In other embodiments, fluid supply 226 may supply distinct fluids having distinct characteristics other than color.

Print head 28 comprises one or more print heads configured to eject one or more fluids through nozzles 234 (schematically represented). In one embodiment, print head 28 comprises one or more drop-on-demand inkjet print heads. In one embodiment, print head 28 comprises a thermoelectric ink jet print head. In other embodiments, print head 28 may comprise other forms of drop-on-demand inkjet print heads, such as piezo electric print heads.

In the example illustrated, the one or more print heads 228 includes nozzle groupings 302K, 302C, 302M, 302Y, and 302Z (collectively referred to as nozzle groupings 302) which are fluidly connected to chambers 300K, 300C, 300M, 300Y, and 300Z, respectively to receive ink from such chambers. In the example illustrated, nozzle groupings 302K, 302C, 302M, 302Y, and 302Z are each arranged in one or more rows. The rows are separated by exterior surfaces 238 extending about and between adjacent nozzle groupings 302 that generally face the surface being printed upon. In one embodiment, such surfaces 238 have a high surface energy relative to the fluid being ejected through nozzles 234. In other words, such surfaces 238 are hydrophilic or fluid-philic with respect to the fluid being ejected through nozzles 234 such that the fluid being ejected through nozzles 234 is less likely to bead up along surfaces 38 and is more likely to spread across surfaces 238, increasing the risk of one fluid traveling or flowing across surface 38 between adjacent nozzles and mixing with another distinct fluid, causing cross-contamination or mixing of distinct fluids or distinct colors of ink along surfaces 238. As will be described hereafter, the mixed inks may further be drawn back through nozzles 234 creating cross-contamination within print head 228.

Although increasing the likelihood of cross-contamination along surfaces 238, such higher surface energies of surfaces 238 may permit a larger range or variety of fluids to be ejected through nozzles 234 with greater control, precision or accuracy. The higher surface energies of surface 238 may permit the ejection of particular fluids or particular inks providing enhanced image quality or providing other desired physical or chemical characteristics of the printed fluid. In one embodiment, surfaces 238 have a surface energy of at least 45 dynes/cm and nominally about 70 dynes/cm. In one embodiment, surface 238 is formed from SU8. In other embodiments, surface 238 may have other surface energies or may be formed from other materials or coated with a secondary layer of significantly reduced surface energy.

Back pressure regulator 230 comprises one or more structures configured to create a fluid back pressure within the interior of fluid supply 226. Back pressure regulator 230 assists in reducing a likelihood of fluid drooling through nozzles 234 onto surfaces 238 during periods of non-use or when printing is not taking place. According one embodiment, back pressure regulator 230 provides a relatively low degree of back pressure, reducing the amount of force or the amount of energy required to expel reject fluid through nozzles 234 against the back pressure of back pressure regulator 230. The relatively low level of back pressure provided by back pressure 230 enables high flow rates necessary for increased throughput printing, which would experience flow starvation when being printed or ejected with fluid supplies 226 having larger back pressures. According to one embodiment, back pressure regulator 230 has a back pressure of less than or equal to 0.5 inches H2O and nominally 1.5 inches H2O. In one embodiment, back pressure regulator 230 may be provided by the capillary action of one or more porous materials such as foams and the like. In another embodiments, back pressure regulator 230 may be provided by a back pressure regulating bag. In other embodiments, back pressure regulator 230 may be provided by other back pressure controlling devices and may provide other levels of back pressure.

Servicing system 224 is configured to service print head 28 of fluid delivery system 22. In particular, servicing system 224 is configured to draw or purge fluid through nozzles 238 to prime nozzles 238, and to remove trapped air from the fluid delivery system 22 that can block fluid flow during printing. Servicing system 224 is further configured to at least partially seal against print head 228 and about nozzles 234 during storage or non-use of print head 228. As shown by FIG. 6, servicing system 224 includes cap 250, absorber 252 (shown in FIG. 12), purging conduit 254, 255, pump 256 (schematically shown in FIG. 6), vent conduit 258, absorber 260 (shown in FIG. 12), valve 262, actuator 264 and controller 266.

Figure 7:
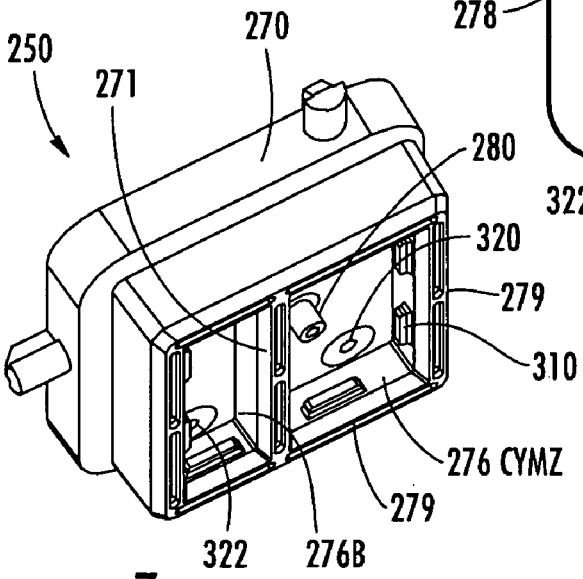
FIG. 7 is a perspective view of a cap of the system of FIG. 6 according to an example embodiment.
Figure 8:
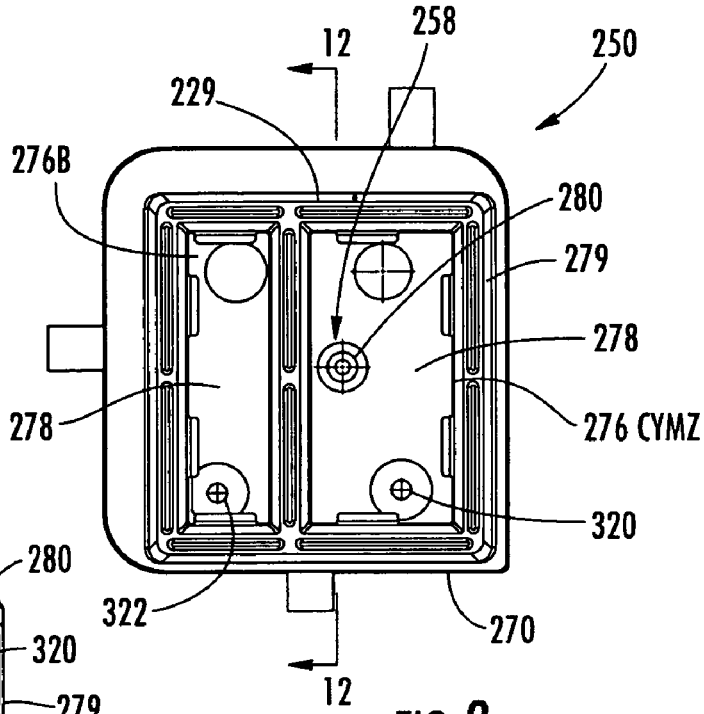
FIG. 8 is a top plan view of the cap of FIG. 7 according to an example embodiment.
Figure 12:
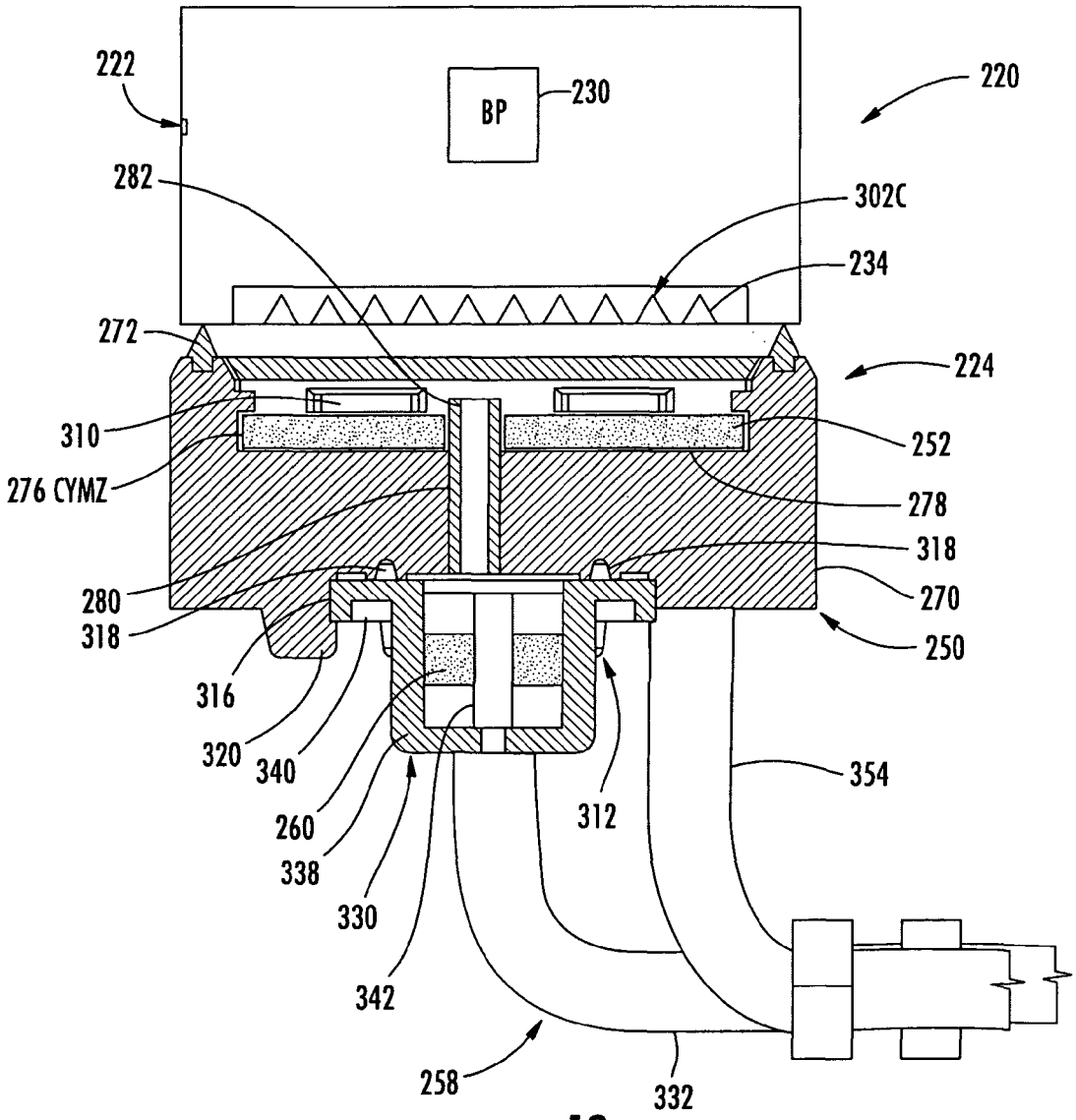
FIG. 12 is a sectional view of the cap of FIG. 8 taken along line 12-12 and the schematically illustrated fluid delivery system of FIG. 6 according to an example embodiment.

FIGS. 7-9 and 12 illustrate cap 250 in more detail. As shown by FIG. 12, cap 250 comprises a structure configured to contact and seal against fluid delivery system 222 so as to form a substantial seal about print head 228, facilitating the priming of nozzles 234 as well as the capping and storage of nozzles 234. Cap 250 includes body 270 and seal 272. Body 270 is configured so as to extend about nozzles 234 of print head 228 when system 222 is positioned against and opposite to body 270. As shown by FIGS. 7 and 8, body 270 further forms basins 276K and 276CYMZ (collectively referred to as basins 276). Basin 276K comprises a cavity configured to extend opposite to nozzle grouping 302 K of print head 228 (shown in FIG. 6) so as to receive fluid ejected through nozzles 234 of grouping 302K. Basin 276CYMZ comprises a cavity configured to extend opposite to nozzles 234 of groupings 302C, 302M and 302Y. Each of Basins 276K and 276CYMZ has a floor 278 and upstanding walls 279 that support seal 272. Basins 276K and 276CYMZ are separated by an intervening wall (or walls) 277 which isolates such basins and which supports a portion of seal 272 that seals against fluid delivery system 222 between nozzle groupings 302K and 302C. In other embodiments, walls 277 make extend between nozzle grouping 302K and another nozzle grouping. In still another embodiment, body 270 of cap 250 and alternatively form a single basin which extends opposite to and about all of the nozzle groupings.

Figure 9:
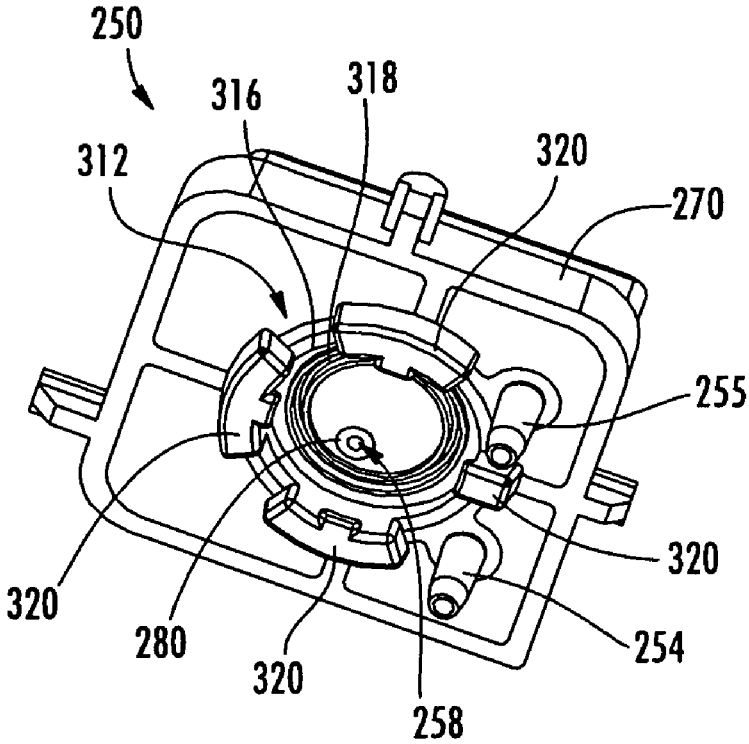
FIG. 9 is a bottom plan view of the cap of FIG. 6 according to an example embodiment.
Figure 10:
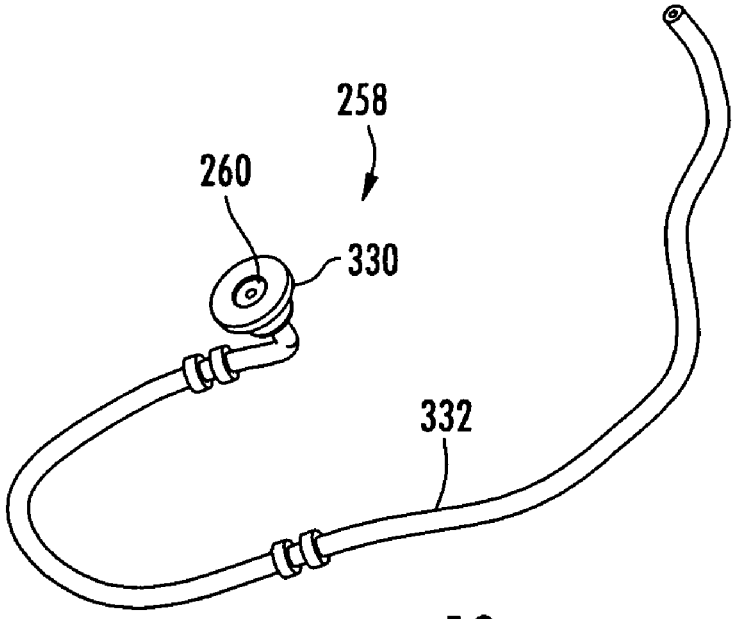
FIG. 10 is a perspective view of a vent tube and header of a vent of the system of FIG. 6 according to an example embodiment.
Figure 11:
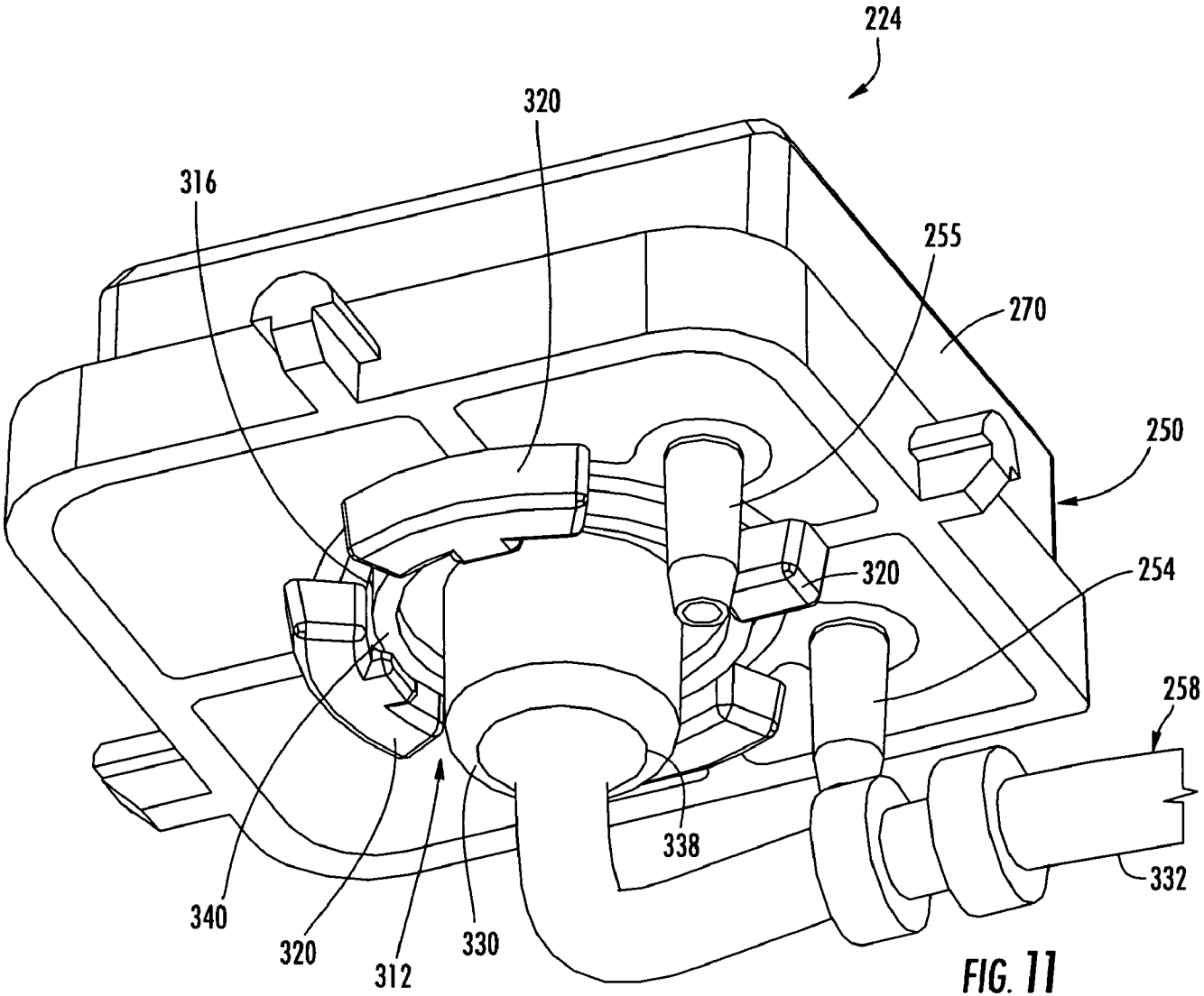
FIG. 11 is an enlarged perspective view illustrating mounting of the vent tube and header of FIG. 10 connected to a bottom of the cap of FIG. 9 according to an example embodiment.

As further shown by FIGS. 7-9, body 270 additionally includes retainers 310 (shown in FIGS. 7 and 8) and header interface 312 (shown in FIG. 9). Retainers 310 comprised tabs inwardly projecting from walls 279. Retainers 310 are configured to bear against a top side of absorber and 252 (shown in FIG. 12). As shown by FIGS. 7 and 8, retainers 310 retain and secure absorbers 252 along floors 278 of basins 276K and 276CYMZ. In other embodiments, retainers 310 may have other configurations. In yet other embodiments, retainers 310 may be omitted. For example, in some embodiments, absorbers 252 may be secured relative to floor 278 in other fashions such as by adhesives or welding.

As shown by FIG. 9, header interface 312 comprises structures configured to releasably secure cap 250 to portions of vent conduit 258. In the example illustrated, interface 312 extends along an exterior of cap 250 and along a bottom of cap 250 opposite to basins 276. Interface 312 includes recess 316, seal 318, and catches 320. Recess 316 comprises a depression or cavity configured to receive a header 330 associated with a vent tube 332. Seal 318 comprises a ring of flexible resilient material configured to form a gasket or seal with the header 330. Catches 320 comprise tabs, hooks or projections configured to extend about or catch against portions of the header 330 to retain the header 330 in recess 316 and against seal 318. In other embodiments, header interface 312 may have a variety of other configurations and may comprise a variety of other mechanisms configured to releasably secure the header 330 and the associated vent tube 332 to cap 250. In embodiments where vent tube is fixedly coupled to cap 250, interface 312 may be omitted.

As shown by FIG. 12, seal 272 comprises a structure configured to bear against and contact portions of system 222 in close conformity so as to seal about nozzles 234. In one embodiment, seal 272 comprises a substantially uninterrupted ring of resiliently flexible elastomer or rubber-like material configured to surround nozzles 234 and serve as a gasket. In other embodiments, in place of seal 272 being provided as part of cap 250, seal 272 may alternatively be provided as part of system 222 about nozzles 234.

As shown by FIG. 12, absorber 252 comprises one or more members received within each of basins 276 and configured to absorb fluid received from nozzles 234. In one embodiment, each absorber 252 comprises a pad of absorbent material such as sintered plastic. In other embodiments, absorber 252 may comprise one or more pads or one or more layers of other materials configured to absorb the fluid or ink purged through nozzles 234. In still other embodiments, one or both of absorbers 252 may be omitted.

As shown by FIGS. 6-8, purge conduits 254, 255 each comprises a passage, conduit, tube or other fluid directing or channeling structure in fluid communication with one of basins 276 such that fluid within basin 276 and retained by absorber 252 may be drawn through conduit 254, 255 out of the basin 276. In the example illustrated, conduit 254 enables fluid to be withdrawn from basin 276CYMZ so as to create a vacuum within base 276CYMZ. Conduit 255 enables fluid to be withdrawn from basin 276K so as to create a vacuum within base 276K. Conduits 254, 255 further permit liquids drawn through nozzles 234 into basins 276 to be withdrawn from basin 76. As shown by FIGS. 7 and 8, conduit 254 has an opening or mouth 320 adjacent to floor 278 of the basin 276CYMZ and extends through body 50. Conduit 255 has an opening or mouth 322 adjacent to floor 278 of the basin 276K and extends through body 270. In other embodiments, conduit 254, 255 may have other configurations.

Pump 256 comprising device configured to draw fluid through conduits 254, 255. In one embodiment, pump 256 comprises a peristaltic pump configured to periodically squeeze or occlude a flexible wall of conduit 254 and of conduit 255 to move fluid through conduit 254, 255. In other embodiments, pump 256 may comprise other devices configured to pump or move fluid through conduit 254, 255 in response to control signals from controller 266.

Vent conduit 258 comprises one or more structures forming and providing a fluid passage extending from the interior of basin 276CYMZ to atmosphere or another source of air. In the example illustrating, vent conduit 258 provides pneumatic flow or communication between the interior basin 276CYMZ and an exterior of cap 250. In one embodiment, vent conduit 258 has an inside diameter sufficiently small and a length sufficiently long so as to reduce or minimize water loss through vent conduit 258 during storage of print head 228. As will be described in more detail hereafter, vent conduit 258 supplies air to basin 276CYMZ during capping and storage of fluid delivery system 222 to maintain a pressure within basin 276 such that the back pressure provided by back pressure regulator 230 is sufficiently large to reduce or inhibit drooling of fluid through nozzles 234 of groupings 302C, 302M and 302Y.

In the example illustrated, vent conduit 258 includes snorkel 280, header 330 and vent tube 332. As shown by FIG. 12, snorkel 280 comprises that portion of vent conduit 258 that extends beyond floor 278 of the basin 276CYMZ into the interior of basin 276CYMZ. Snorkel 280 projects beyond floor 278 by distance sufficient such that the inlet opening or mouth 282 of snorkel 280 is elevated beyond or above the top of the absorber 52. The snorkel 80 is elevated beyond or above the top of the absorber 52 such that residual ink after a purge or unexpected drool while capped will be contained within the absorber 52 and not leak into the vent conduit 58 via the snorkel opening 82. The snorkel 282 assists in reducing the amount of liquid that may flow into vent conduit 258 and potentially form a blockage leading to a flow restriction in vent conduit 258. In other words, snorkel 282 assists in keeping vent conduit 258 dry and open. In other embodiments, snorkel 280 may be omitted. In the example illustrated, snorkel 280 further extends through body 270 from floor 278 of basin 276CYMZ to recess 316 of interface 312.

Header 330 comprises a structure configured to connect cap 250 with vent tube 332. In the example illustrated, header 330 is further configured to serve as an accumulator, collecting liquid fluid that may have entered vent conduit 258 and inhibiting such liquid from creating a blockage in the fluid passage provided by vent conduit 258. As shown by FIG. 12, header 330 includes container portion 338 and rim 340. Container portion 338 forms a hollow interior container which contains absorber 260 and which further surrounds a fluid passage 342 extending through container portion 338. Rim 340 outwardly projects from container portion 338 and is configured to be pressed and held against seal 318 by catches 320 such that the interior of container 338 is in fluid communication with or fluidly connected to the internal fluid passage of snorkel 280. A lower portion of container portion 338 is secured to vent tube 332.

Vent tube 332 comprises an elongate tube extending from header 330 which provides an internal fluid passage to atmosphere. In the embodiment illustrated, vent tube 332 has outer compressible walls, or at least a portion of which is compressible, such that valve 262 may selectively pinch or occlude the fluid passage of tube 332. In the example illustrated, tube 332 has a sufficiently small internal diameter and a sufficiently long length so as to inhibit moisture or water loss from basin 276CYMZ even when tube 332 is in an open state during capping storage of print head 228.

Because vent tube 332 is removably or releasably connected to cap 250 by header 330, tube 332 may be easily removed and separated for repair or replacement without discarding a remainder of servicing system 224. For example, should absorber 260 become saturated or should tube 332 become blocked with dried internal fluid, tube 332 or header 330 may be replaced. In the example illustrated, header 330 facilitates removal connection or disconnection of tube 332 with respect to cap 250 manually without the use of tools by simply snapping header 330 in place with respect to interface 312. In other embodiments, header 330 may facilitate removable connection or disconnection with tools or in other fashions. In other embodiments, header 330 or vent tube 332 may alternatively be fixedly or permanently mounted or attached to body 270 of cap 250.

As shown by FIG. 12, absorber 260 comprises one or more members configured to absorb liquid. Absorber 260 is supported or located in communication with the fluid passage provided by vent conduit 258 so as to absorb any liquid that may collect within the fluid passage of vent conduit 258. In the embodiment illustrated, absorber 260 completely surrounds or extends about the fluid passage of vent conduit 258. For example, in one embodiment, absorber 260 comprises a ring of absorbent material. Because absorber 260 extends completely around or about the fluid passage, absorber 260 has enhanced effectiveness in absorbing any liquids that may collect within vent conduit 258 and in keeping vent conduit 258 dry and open. In other embodiments, absorber 260 includes multiple portions staggered about the fluid passage of vent conduit 258 or may extend along sides of the fluid passage.

In the example illustrated, absorber 260 is located proximate to floor 278 of basin 276. As a result, absorber 260 is more likely to absorb liquid that may enter vent conduit 258. In other embodiments, absorber 260 may be provided in other locations along vent conduit 258. In one embodiment, absorber 260 may be formed from a liquid absorbent material such as sintered plastic. In other embodiments, absorber 260 may be formed from other of liquid absorbent materials. In still other embodiments, absorber 260 may be omitted.

Valve 262 comprises a mechanism situated along vent tube 258 and configured to selectively open and close vent conduit 258. Actuator 264 comprises a mechanism configured to actuate or move valve 262 between a vent closing state and a vent opening state. Actuator 64 actuates valve 262 in response to control signals received from controller 266. In one embodiment, actuator 264 comprises an electric solenoid. In other embodiments, actuator 264 may comprise other mechanisms such as motor driven cam arrangements, hydraulic or pneumatic cylinder-piston assemblies and the like.

As schematically shown by FIG. 6, controller 266 comprises one or more processing units configured to generate control signals directing at least the operation of pump 256 and actuator 264. Controller 266 generates control signals such that system 220 operates in accordance with method 100 described above with respect to FIG. 5. Like system 20, system 220 provides a pneumatic vent which is less likely to become occluded or blocked by a liquid meniscus that forms inside the vent as a result of priming. As a result, during subsequent capping or storage of a print head, system 220 provides an open vent to counteract any drop in pressure caused by cooling air within the basin and to reduce the likelihood of fluids drooling through nozzles and spreading across the surface of the print head. Such issues are especially prevalent in systems that have relatively low back pressures and that have print heads with high surface energies where low back pressure and blockages in the system may lead to drooling and wherein the mobility of the ink on the surface may lead to cross contamination or mixing in the event of a drool.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a print storage cap having a basin configured to seal against a print head;

a conduit connected to an interior of the basin;

a pump configured to move fluid through the conduit;

a vent connected to the interior of the basin;

a valve configured to open and close the vent; and a controller configured to generate control signals opening the vent during storage of a print head against the basin, closing the vent during pumping of a fluid by the pump; opening the vent substantially immediately upon cessation of the pumping and initiating pumping by the pump substantially immediately upon the opening of the vent.

2. The apparatus of claim 1, wherein the basin has an opening in communication with the vent and wherein the apparatus further comprises an absorber surrounding the vent outside the interior of the basin.

3. The apparatus of claim 2, wherein the absorber comprises a ring encircling a passage of the vent to draw ink from the passage.

4. The apparatus of claim 1, wherein the vent comprises a vent tube releasably connected to an underside of the cap.

5. The apparatus of claim 4, wherein the basin has an opening in the interior of the basin and further comprises a header connected to the vent tube and configured to seal against the underside of the cap.

6. The apparatus of claim 5, wherein the tube has a tube opening adjacent to the header and wherein the vent further comprises an absorber in the header about the tube opening.

7. The apparatus of claim 1, wherein the vent further comprises a snorkel projecting above a floor of the basin.

8. The apparatus of claim 7, wherein the vent further comprises a vent tube removably coupled to the cap, wherein the snorkel is coupled to the cap so as to remain with the cap upon separation of the cap from the vent tube.

9. The apparatus of claim 7, wherein the snorkel extends from the floor of the basin to a snorkel opening above the floor of the basin.

10. The apparatus of claim 1 further comprising an absorber about the vent within the interior of the basin.

11. The apparatus of claim 10, wherein the vent further comprises a snorkel projecting above the absorber.

12. The apparatus of claim 10, wherein the absorber comprises a ring encircling an opening of the vent within the interior of the basin.

13. The apparatus of claim 1 further comprising the print head, wherein the print head includes nozzle openings surrounded by surfaces having surface energies of at least about 45 dynes/cm.

14. The apparatus of claim 13 further comprising a fluid delivery system including the print head, wherein the ink delivery system is configured to supply different colors of ink to different nozzles of the print head.

15. The apparatus of claim 1 further comprising a fluid delivery system including the print head, wherein the ink delivery system has a back pressure of no less than 0.5 inches of H2O when not printing.

16. The apparatus of claim 1, wherein the controller is configured to generate control signals such that pumping is initiated substantially immediately upon the opening of the vent such that liquid within the basin flow into the vent after the opening of the vent and prior to the initiation of pumping by the pump.

17. A method comprising:

creating a vacuum in a storage while the print head is sealed against a cap to prime the print head;

maintaining an atmospheric vent to the cap in a closed state during priming of the print head;

upon cessation of the creation of a vacuum in the print head storage cap, substantially immediately opening the atmospheric vent to the cap; and upon opening of the atmospheric vent, substantially immediately starting pumping of fluid from the cap; and maintaining the atmospheric vent to the cap in an open state during storage of a print head against the cap.

18. The method of claim 17, wherein the print head includes nozzles surrounded by surfaces having a having surface energies of at least about 45 dynes/cm.

19. The method of claim 18 further comprising ejecting a first color of ink through a first one of the nozzle openings and ejecting a second color of ink through a second one of the nozzle openings.

20. The method of claim 17 further comprising forming a back pressure of no less than 0.5 inches of H2O behind the print head when not printing.

21. The method of claim 17 further comprising releasably connecting a vent tube to the storage cap, wherein the vent tube at least partially provides the atmospheric vent.

22. The method of claim 17 further comprising absorbing fluid about the atmospheric vent with an absorber outside the cap.

23. The method of claim 17 further comprising forming the atmospheric vent with a snorkel having an opening elevated above a floor of the storage cap.

24. An apparatus comprising:

means for creating a vacuum in a storage cap while a print head is sealed against the cap to prime fluid from the print head;

means for maintaining atmospheric vent to the cap in a closed state during priming of fluid from the print head;

means for opening the atmospheric vent upon cessation of the creation of a vacuum in the print head storage cap; and means for starting pumping fluid from the cap substantially immediately upon opening the atmospheric vent; and means for maintaining the atmospheric vent to the cap in an open state during storage of a print head against the cap.

* * * * *